United States Patent [19]

Matievic

[11] Patent Number: 4,935,909

[45] Date of Patent: Jun. 19, 1990

[54] PIEZOELECTRIC SIGNALING DEVICE

[75] Inventor: Miroslav Matievic, Indianapolis, Ind.

[73] Assignee: Emhart Industries Inc., Towson, Md.

[21] Appl. No.: 940,251

[22] Filed: Dec. 10, 1986

[51] Int. Cl.[5] ..... H04R 17/00

[52] U.S. Cl. ..... 367/140; 310/316; 310/317; 367/157

[58] Field of Search ..... 367/140, 157, 901, 903; 310/316, 317; 368/255

[56] References Cited

U.S. PATENT DOCUMENTS

| | | | |
|---|---|---|---|
| 3,742,492 | 6/1973 | Proctor | 310/316 |
| 4,277,824 | 7/1981 | Alberkrack | 363/49 |
| 4,393,373 | 7/1983 | Torii et al. | 310/316 |
| 4,520,289 | 5/1985 | Sato et al. | 310/316 |
| 4,529,845 | 7/1985 | Boeckmann | 379/379 |
| 4,587,958 | 5/1986 | Noguchi et al. | 310/316 |

*Primary Examiner*—Charles T. Jordan
*Assistant Examiner*—J. Woodrow Eldred
*Attorney, Agent, or Firm*—Edward D. Murphy

[57] ABSTRACT

A piezoelectric signaling device has an oscillator circuit which includes a transistor amplifier and a piezoelectric transducer. There is a Zener diode in the transistor circuit. The Zener voltage of the diode determines the start-up voltage of the device. By choosing diodes with different Zener voltages, the start-up voltage may be preselected. In other embodiments, the diode may be connected in the base circuit of the transistor or in other portions of the oscillator circuit.

1 Claim, 1 Drawing Sheet

PIEZOELECTRIC SIGNALING DEVICE

BACKGROUND OF THE INVENTION

1. Field of the Invention

The invention in general relates to audio signaling devices having piezoelectric transducers which produce a sound signal, and more particularly to such a signaling device in which the start-up voltage may be preselected.

2. Description of the Prior Art

Audio signaling devices are widely used to signal the change of a condition or as a warning or alarm device in appliances, computers, detectors, specialized electronic devices, production machines, and many other applications. With the proliferation of the various types of electronic and other systems which employ such signaling devices, it has become important that such signaling devices be able to operate within many different voltage environments. In order to generate satisfactory and measurable sound output, sound devices of this type are specified over a voltage range where the low voltage of the range is higher than the start-up voltage. A signaling device that will not operate at all in one system that cannot produce a voltage high enough to drive it, may operate continuously in another system that has an "off-voltage" that is higher than the start-up voltage for the device. For example, a typical piezoelectric signaling device may have a start-up voltage of 0.6V, which start-up voltage is not acceptable for applications in some types of logic circuitry where the off-voltages are typically higher than 0.6V or in situations where the noise on supply lines can be higher than 0.6V. Thus it would be highly desirable to have a piezoelectric signaling device in which the start-up voltage can be preselected to be any one of a number of different voltages. In addition, with the systematic and steady miniaturization and decrease in cost of the electronic systems which the signaling device is made a part of, it is important that the means of preselecting the starting voltage be small and inexpensive so that it does not add significantly to the overall size and cost of the signaling device.

SUMMARY OF THE INVENTION

It is an object of the invention to provide a piezoelectric signaling device in which the start-up voltage may be preselected to be one of a number of different voltages.

It is another object of the invention to provide the above object in a piezoelectric signaling device which is small and inexpensive to manufacture.

It is a further object of the invention to provide the above objects in a piezoelectric signaling device in which the start-up voltage can be determined simply by selecting a different one of a number of Zener diodes.

The invention provides, in a piezoelectric signaling device of the type having an oscillator circuit including an amplifier and a piezoelectric transducer having a feedback electrode, the combination with said amplifier of a means for preselecting the start-up voltage of the device. Preferably, the amplifier includes a transistor and the means for preselecting the start-up voltage comprises a Zener diode. In one embodiment, the Zener diode is part of the emitter circuit of the transistor. In another embodiment, the Zener diode is part of the base circuit of the transistor.

The signaling device according to the invention can be manufactured using a minimal number of electrical components at a low cost, and yet can provide a wide range of start-up voltages. Other features, objects and advantages of the invention will become apparent from the following detailed description when read in conjunction with the accompanying drawings.

DESCRIPTION OF THE PREFERRED EMBODIMENT

Figure 1:
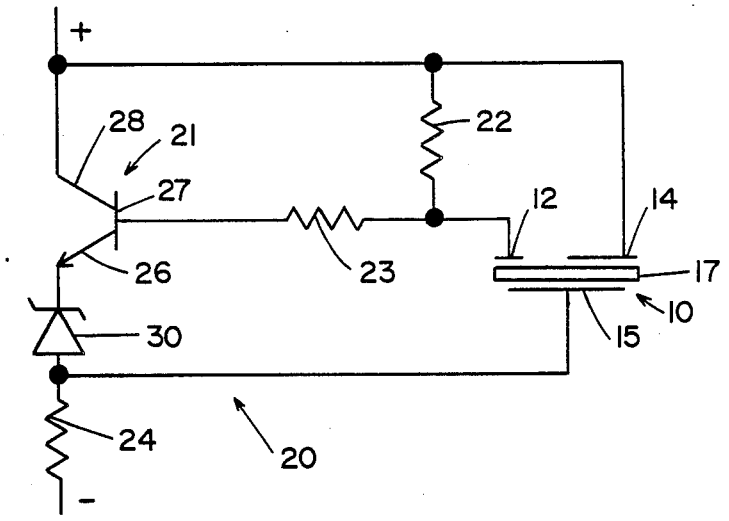
FIG. 1 is an electrical circuit diagram of a preferred embodiment of a piezoelectric signaling device according to the invention having a Zener diode in the emitter circuit of a transistor.

Directing attention to FIG. 1, a detailed electric circuit diagram of a preferred embodiment of the invention is shown. The Fig. shows a piezoelectric signaling device of the type having an oscillator circuit 11 which includes a piezoelectric transducer 10 having a feedback electrode 12 and an amplifier circuit 20 that includes a transistor 21 and three resistors 22, 23 and 24. There is also a means for preselecting the start-up voltage of the device 30, which in this embodiment is a Zener diode 30 connected to the emitter 26 of transistor 21.

Turning now to a more detailed description of the invention, transducer 10 also includes electrodes 14 and 15 which drive piezoelectric crystal 17. Electrode 14 is connected to the positive voltage input terminal. Resistor 22 is connected between electrode 14 and feedback electrode 12. Resistor 23 is connected between the feedback electrode 12 and the base 27 of transistor 21. Resistor 24 is connected between the negative voltage input terminal and electrode 15. Zener diode 30 is connected between electrode 15 and emitter 26 of transistor 21 with the cathode of the diode toward the emitter. The collector 28 of transistor 21 is connected to the positive voltage terminal.

The Zener diode connected as shown in FIG. 1 can effectively be used to preselect the start-up voltage in many similar circuits: for example, for common emitter circuits or for circuits with transducer connected across the emitter resistor.

Figure 2:
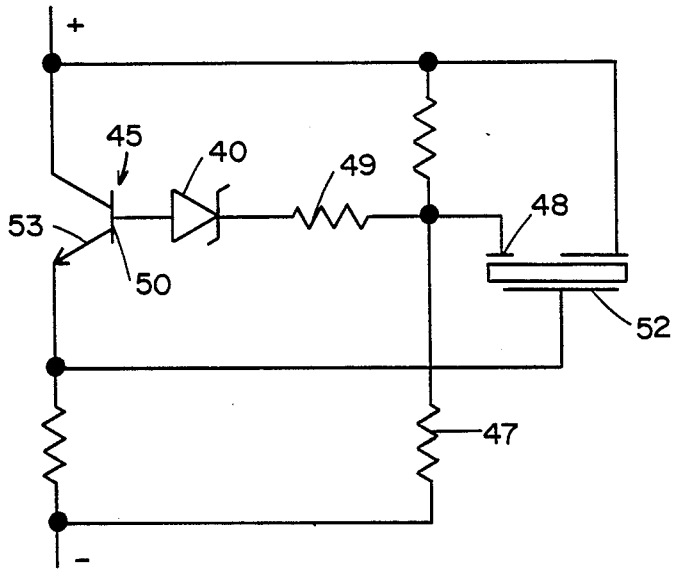
FIG. 2 is an electrical circuit diagram of another preferred embodiment of a piezoelectric signaling device according to the invention having a Zener diode in the base circuit of a transistor.

The Zener diode can also be connected in different parts of the circuit with similar effect. FIG. 2 shows circuit with a Zener diode connected to the base of transistor. This circuit is the same as that of FIG. 1 except that resistor 47 is connected between the feedback electrode 48 and the negative input voltage terminal and Zener diode 40 is connected between resistor 49 and the base 50 of transistor 45 with the anode of the diode toward the base. In this case, the negative electrode 52 is connected directly to the emitter 53 of the transistor 45.

The values of the resistors 22, 23 and 24 are selected as known in the art to determine the desired oscillator frequency of the transducer. In the embodiment shown, resistors 22, 23, 24, 47 and 49 may have the values 47K ohm, 1K ohm, 1.5K ohm, 12OK ohm, and 1K ohm respectively. In the circuit of FIG. 1 powered with 28V dc, a start-up voltage of 3.8V can be preselected by choosing a diode 30 having a Zener voltage of 2.5V while a diode having a Zener voltage of 6.5V will produce a start-up voltage of 7.5V. In FIG. 2, preferably a 2.5V diode produces a start-up voltage of about 3.3V. Resistors 47 and 49 may not be required in some circuits. A wide range of start-up voltages may be obtained similarly by choosing other diodes.

A novel piezoelectric signaling device in which the start-up voltage may be preselected has been described. It is evident that those skilled in the art may now make many uses and modifications of the specific embodiments described without departing from the inventive concepts. For example, other equivalent electronic parts may be used or additional parts and/or features may be added. A Zener diode may be connected, for example, in the collector branch of the circuit or in the power line with similar effect. Consequently, the invention is to be construed as embracing each and every novel feature and novel combination of features present in the piezoelectric signaling device described.

What is claimed is:

1. In a piezoelectric signaling device of the type having an oscillator circuit including an amplifier and a piezoelectric transducer having a feedback electrode, said device having a start-up voltage, the combination with said amplifier of a means for preselecting the start-up voltage of the device, wherein said means for preselecting comprises a Zener diode, said amplifier includes a transistor, and said Zener diode is connected to the base of said transistor.

* * * * *